US005409218A

United States Patent [19]

You

[11] Patent Number: 5,409,218

[45] Date of Patent: Apr. 25, 1995

[54] METAL GAME RACKET

[76] Inventor: Chin-San You, No. 6, Lane 477, Sec. 2, Feng-Shyn Rd., Feng Yuan City, Taichung Hsien, Taiwan, Prov. of China

[21] Appl. No.: 178,855

[22] Filed: Jan. 7, 1994

[51] Int. Cl.[6] ..... A63B 49/08

[52] U.S. Cl. ..... 273/75; 273/73 H

[58] Field of Search ..... 273/73 R, 73 G, 73 H, 273/73 J

[56] References Cited

U.S. PATENT DOCUMENTS

| | | | |
|---|---|---|---|
| 2,742,289 | 4/1956 | Allward | 273/73 H |
| 3,948,519 | 4/1976 | Portz et al. | 273/73 J |
| 4,671,511 | 6/1987 | Trysinsky | 273/73 J |
| 5,092,594 | 3/1992 | Jang | 273/73 J X |
| 5,282,618 | 2/1994 | Hong | 273/73 J |

FOREIGN PATENT DOCUMENTS

| | | | |
|---|---|---|---|
| 2262045 | 6/1993 | United Kingdom | 273/73 J |

*Primary Examiner*—Raleigh W. Chiu

*Attorney, Agent, or Firm*—Browdy and Neimark

[57] ABSTRACT

An improved metal game racket comprises a frame, a shaft and a handle. The frame has a head with an open end from which the shaft extends to join with the handle having a main body of a polymer material. The main body has an inner surface provided thereon with a reinforcing layer and further has an outer surface provided thereon with an auxiliary shock-absorbing layer. The main body has an anterior segment connected with the shaft and a posterior segment of hollow construction and extending from one end of the anterior segment. The reinforcing layer is made of a fiber reinforced plastic material while the auxiliary shock-absorbing layer is made of a plastic foam body.

13 Claims, 3 Drawing Sheets

METAL GAME RACKET

FIELD OF THE INVENTION

The present invention relates generally to a game racket, and more particularly to a game racket having a metal frame.

BACKGROUND OF THE INVENTION

The prior art metal game racket is generally composed of a metal head frame, a shaft and a handle covered with a layer of polyurethane foam body for easy gripping. Such a metal game racket of the prior art as described above is defective in design in that the shock wave can be easily transmitted from the head frame to the hand grip to inflict the so-called "tennis elbow" on a player.

SUMMARY OF THE INVENTION

It is, therefore, the primary objective of the present invention to provide an improved metal game racket which does not inflict the tennis elbow on a tennis player.

In keeping with the principle of the present invention, the foregoing objective of the present invention is attained by an improved metal game racket, which comprises a metal frame having a head, a shaft extending downwards from one end of the head, and a handle connected with the open end of the shaft. The handle is characterized in that it comprises a main body of polymer and having an anterior segment connected with the open end of the shaft and further having a posterior segment extending axially from the anterior segment. The shock wave generated by the head impacted by a ball is transmitted from the head to the shaft and is then attenuated in the anterior segment of the main body of the handle. As a result, the hand of a player holding the metal game racket of the present invention is not susceptible to the tennis elbow.

DETAILED DESCRIPTION OF THE INVENTION

Figure 1:
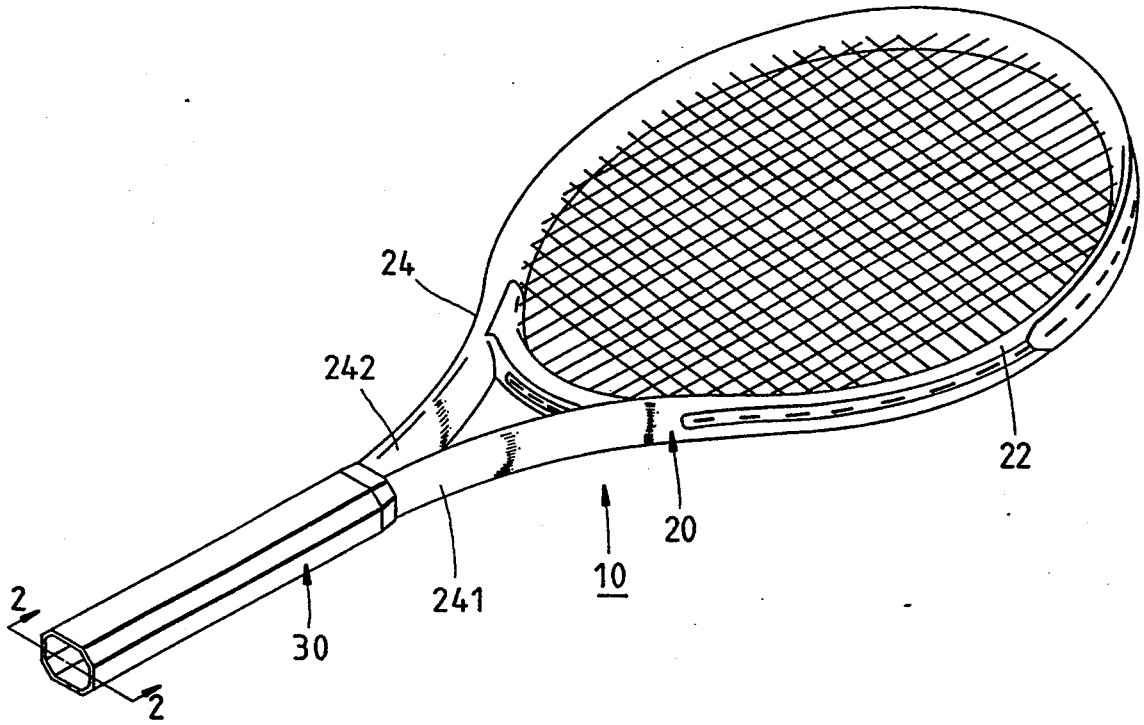
FIG. 1 shows a perspective view of a first preferred embodiment of the present invention.
Figure 2:
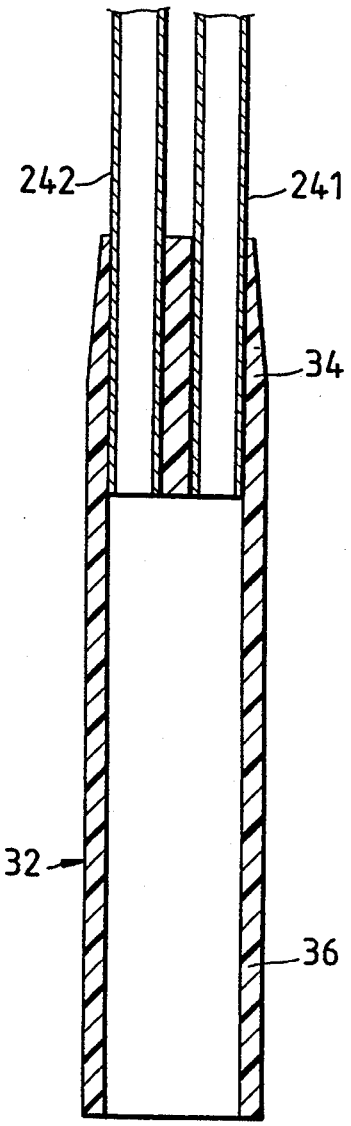
FIG. 2 shows a sectional view of a portion taken along the line 2—2 as shown in FIG. 1.

Referring to FIGS. 1 and 2, a metal game racket 10 of the first preferred embodiment of the present invention is shown to be composed of a frame 20 and a handle 30.

The frame 20 is made of an aluminium alloy tube having a shuttle-shaped cross section and is composed of a head 22 and a shaft 24. The head 22 of oval construction is provided with a ball-striking surface 26 formed by the interlacing strings. The two open ends of the head 22 extend toward the handle 30 to form the shaft 24 which has two merging ends 241 and 242 of equal or unequal length.

The handle 30 comprises a main body 32 of a polymer such as epoxy resin and having an octagonal cross section. The handle 30 is divided into an anterior segment 34 and a posterior segment 36, with the anterior segment 34 having a length equal to about one third of the length of the handle 30. The anterior segment 34 is used to cover the merging ends 241 and 242 of the shaft 24, as shown in FIG. 2. The posterior segment 36 is of hollow construction and extends axially from the open end of the shaft 24. In the process of making the game racket 10, the merging ends 241 and 242 may be provided with a core (not shown in the drawings) inserted thereinto before they are arranged in the mold cavity of a molding tool into which a molten polymer is subsequently injected. Upon completion of the cooling of the injected polymer, the core is removed therefrom. As a result, the main body 32 is thus formed.

Upon being impacted by a ball, the head 22 generates a shock wave, which is transmitted along the shaft 24 to reach the anterior segment 34 of the main body 32. As a result, the magnitude of the shock wave is greatly reduced in view of the fact that the shock-transmitting medium is changed from the metal to the polymer.

Figure 3:
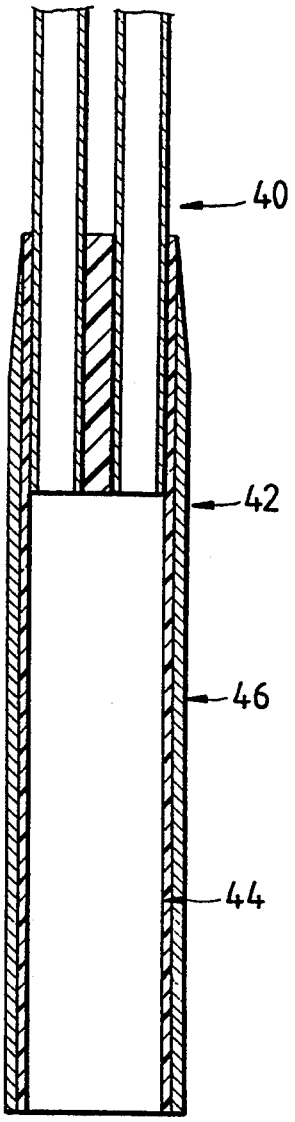
FIG. 3 shows a sectional view of a portion of a second preferred embodiment of the present invention, with the portion being taken in the direction similar to the line 2—2 as shown in FIG. 1.
Figure 4:
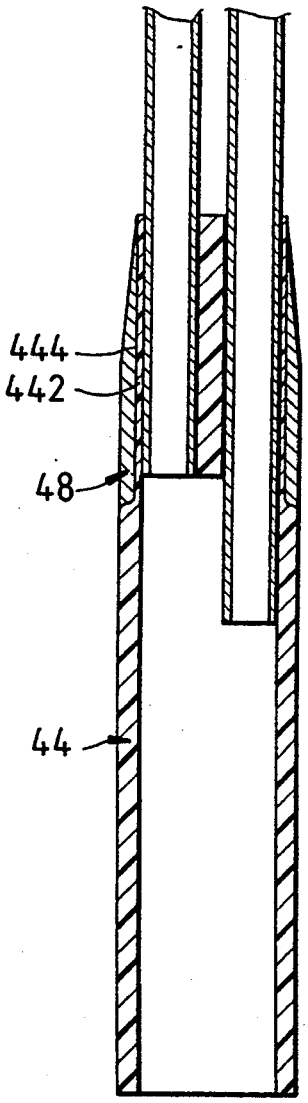
FIG. 4 shows a sectional view of a portion of a third preferred embodiment of the present invention, with the portion being taken in the direction similar to the line 2—2 as shown in FIG. 1.
Figure 5:
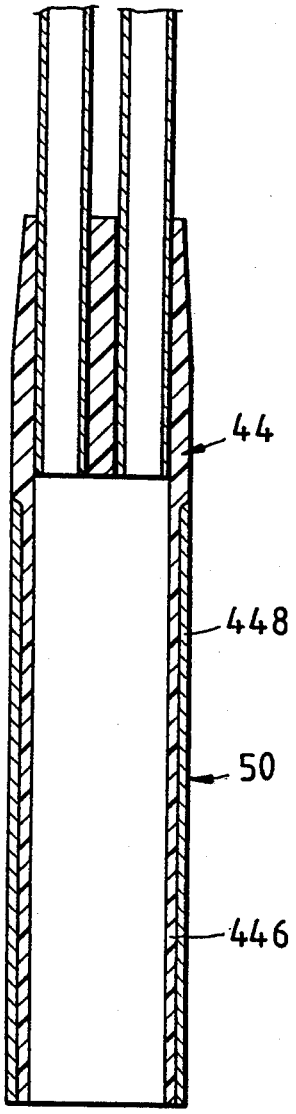
FIG. 5 shows a sectional view of a portion of a fourth preferred embodiment of the present invention, with the portion being taken in the direction similar to the line 2—2 as shown in FIG. 1.

As shown in FIG. 3, a metal game racket 40 of the second preferred embodiment of the present invention comprises a handle 42 having a main body 44 of a polymer. The main body 44 is covered with an auxiliary shock-absorbing layer 46 of a plastic foam body. However, the anterior segment 442 of the main body 44 may be provided with a first annular recessed area 444, as shown in FIG. 4. The first recessed area 444 is covered with an auxiliary shock-absorbing layer 48 of a plastic foam body, such as polyurethane foam body. The posterior segment 446 of the main body 44 is provided with a second annular recessed area 448, as shown in FIG. 5, which is covered with an auxiliary shock-absorbing layer 50 of a plastic foam body. The auxiliary shock-absorbing layers 46, 48 and 50 serve dual purposes of adjusting the weight of the handle 42 and absorbing the shock wave transmitted thereto from the head of the metal game racket 40.

Figure 6:
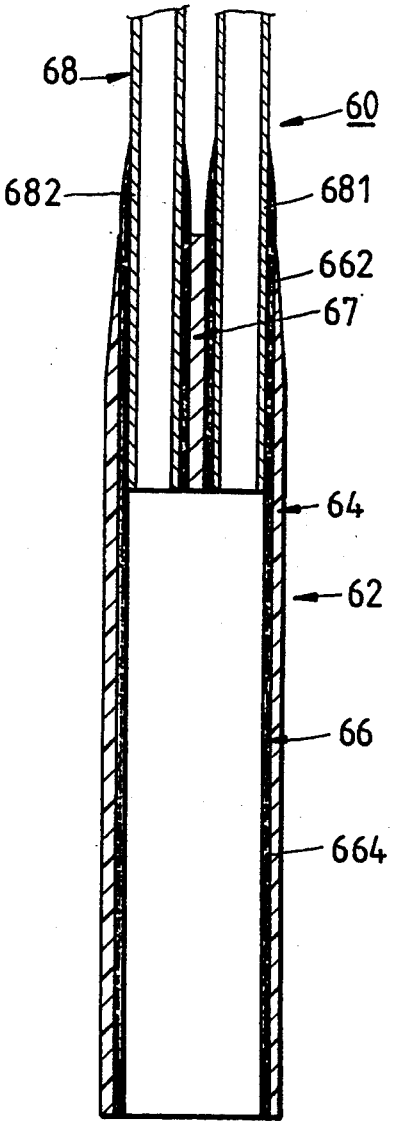
FIG. 6 shows a sectional view of a portion of a fifth preferred embodiment of the present invention, with the portion being taken in the direction similar to the line 2—2 as shown in FIG. 1.
Figure 7:
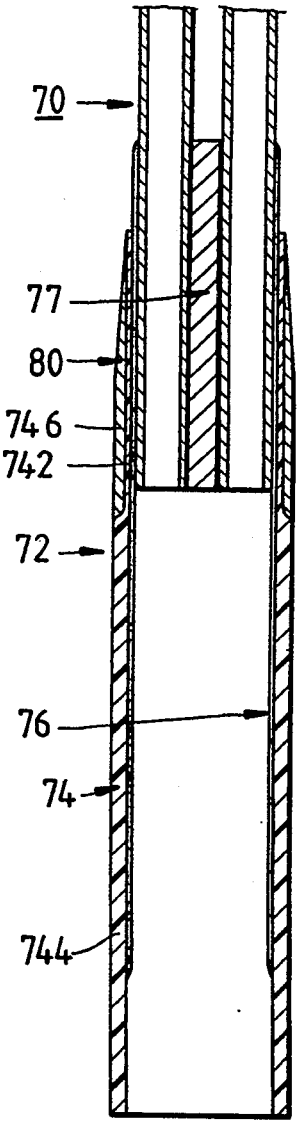
FIG. 7 shows a sectional view of a portion of a sixth preferred embodiment of the present invention, with the portion being taken in the direction similar to the line 2—2 as shown in FIG. 1.

Now referring to FIGS. 6 and 7, another metal game racket 60 embodied in the present invention is shown to comprise a handle 62, which is composed of a main body 64 of a polymer material, a reinforcing layer 66 and an insertion block 67. The reinforcing layer 66 is made of a fiber reinforced plastic material, such as long fiber fabric sheets preimpregnated with epoxy resin. The reinforcing layer 66 has a covering portion 662, which is used to cover the two merging ends 681 and 682 of the metal shaft 68. The reinforcing layer 66 further has an extension portion 664 of a predetermined length and extending from the end of the covering portion 662 along the inner side of the posterior segment 644 of the main body 64. The insertion block 67 is made of a plastic foam body, such as polyurethane foam body, and is lodged between the two merging ends 681 and 682. In the process of making the metal game racket 60, the insertion block 67 is first disposed between the two merging ends 681 and 682, which are then wrapped around with long fiber fabric sheets preimpregnated with epoxy resin so as to form thereon the reinforcing layer 66. The merging ends 681, 682, the reinforcing layer 66 and the insertion block 67 are then arranged in the mold cavity of a molding tool into which the molten polymer is subsequently injected to form therein the main body 64 of the handle 62. The reinforcing layer 66 serves to reinforce the fastening of the handle 62 with the shaft 68. In addition, as shown in FIG. 7, the handle 72 of another metal game racket 70 embodied in the present invention comprises a main body 74 provided with a reinforcing layer 76, an insertion block 77, and an anterior segment 742 having an annular recessed area 746 which is covered with an auxiliary shock-absorbing layer 80 of a plastic foam body. The reinforcing layer 76 extends to reach halfway of the posterior segment 744 of the main body 74.

What is claimed is:

1. An improved metal game racket comprising:

a frame of a metal tube and having a head and a shaft extending downwards from one end of said head; and a handle connected with an open end of said shaft;

wherein said handle is composed of a main body of a polymer and having an anterior segment covering said open end of said shaft, said main body further having a posterior segment extending axially from said anterior segment, wherein said posterior segment of said main body of said handle is of a hollow construction, wherein a reinforcing layer is provided between said main body and said open end of said shaft, said reinforcing layer being made of a fiber reinforced plastic material, said reinforcing layer having a covering portion which covers said open end of said shaft, said reinforcing layer further having an extension portion of a predetermined length and extending from one end of said covering portion along an inner surface of said posterior segment of said main body.

2. The improved metal game racket of claim 1 wherein said main body has an outer surface provided with an auxiliary shock-absorbing layer of a plastic foam body.

3. The improved metal game racket of claim 2 wherein said auxiliary shock-absorbing layer covers an outer surface of said anterior segment of said main body.

4. The improved metal game racket of claim 3 wherein said anterior segment of said main body is thinner than said posterior segment of said main body and is provided on said outer surface thereof with a first annular recessed area in which said auxiliary shock-absorbing layer is disposed.

5. The improved metal game racket of claim 2 wherein said auxiliary shock-absorbing layer covers an outer surface of said posterior segment of said main body.

6. The improved metal game racket of claim 5 wherein said posterior segment of said main body is thinner than said anterior segment of said main body and is provided on said outer surface thereof with a second annular recessed area in which said auxiliary shock-absorbing layer is disposed.

7. The improved metal game racket of claim 1 wherein said head is of an oval construction and has two open ends from which said shaft extends toward said handle to form two merging ends which are covered with said anterior segment of said main body.

8. The improved metal game racket of claim 7 wherein a reinforcing layer is provided between said main body and said shaft, said reinforcing layer being made of a fiber reinforced plastic material and having a covering portion and an extension portion, with said covering portion covering said two merging ends of said shaft, and with said extension portion extending axially from one end of said covering portion along an inner surface of said posterior segment of said main body.

9. The improved metal game racket of claim 7 wherein said two merging ends of said shaft are provided therebetween an insertion block of a plastic foam body.

10. The improved metal game racket of claim 7 wherein said main body has an outer surface provided thereon with an auxiliary shock-absorbing layer of a plastic foam body.

11. The improved metal game racket of claim 10 wherein said auxiliary shock-absorbing layer covers an outer surface of said anterior segment of said main body.

12. The improved metal game racket of claim 10 wherein said auxiliary shock-absorbing layer covers an outer surface of said posterior segment of said main body.

13. The improved metal game racket of claim 10 wherein said outer surface of said main body is provided with an annular recessed area in which said auxiliary shock-absorbing layer is disposed.

* * * * *